United States Patent [19]

Claras

[11] 4,230,354

[45] Oct. 28, 1980

[54] PICK UP AND DISPOSAL KIT FOR PET ORDURE

[76] Inventor: Eleanor Claras, 239 Greenmeadow Way, Palo Alto, Calif. 94306

[21] Appl. No.: 955,014

[22] Filed: Oct. 26, 1978

[51] Int. Cl.[3] ..... A01K 29/00; A47L 13/52

[52] U.S. Cl. ..... 294/1 B; 15/257.1

[58] Field of Search ..... 294/1 B, 1 BA, 1 BB, 294/55; 15/104.8, 257.1, 257.5, 257.6, 257.7, 257.9; 229/53, 55, 62

[56] References Cited

U.S. PATENT DOCUMENTS

| | | | |
|---|---|---|---|
| 3,286,826 | 11/1966 | Stoll | 229/53 X |
| 3,639,937 | 2/1972 | Sweeney | 15/104.8 |
| 3,767,247 | 10/1973 | Wetzler | 294/1 B |
| 3,806,984 | 4/1974 | Hilsabeck | 15/257.6 X |
| 3,830,423 | 8/1974 | Prescott | 15/257.5 X |
| 3,854,578 | 12/1974 | Sharpe | 294/1 B UX |
| 3,917,333 | 11/1975 | Grattan | 294/1 B |
| 3,971,503 | 7/1976 | Allan et al. | 294/1 B |
| 3,977,715 | 8/1976 | Casci | 294/1 BA |
| 4,017,015 | 4/1977 | Jefferson | 294/1 B |
| 4,103,952 | 8/1978 | Thompson | 294/55 X |
| 4,138,153 | 2/1979 | Brown | 15/257.1 X |

*Primary Examiner*—Johnny D. Cherry
*Attorney, Agent, or Firm*—Thomas H. Olson

[57] ABSTRACT

An impervious bag formed of plastic or the like and a semirigid foldable band secured around the mouth of the bag. The band has a linear portion which conforms to a ground surface to afford transportation of ordure thereover into the bag. Remote from the linear portion the band defines foldable gripping portions which enables the user to grip the band exterior of the bag and to manipulate the linear portion for efficient and sanitary use. Joined to the linear portion is a second ply which enhances the rigidity thereof, there being a segment joined to the second ply along a perforated line. When the device is marketed and stored the segment forms with the ply an enclosure for the kit and when the segment is removed from the ply by tearing along the perforated line, the segment in conjunction with a rigid handle forms a pusher for transporting the ordure over the linear portion to the bag interior.

4 Claims, 6 Drawing Figures

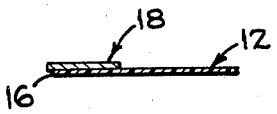
Fig-3
Fig-5
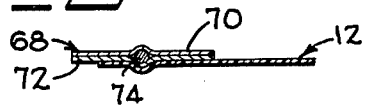
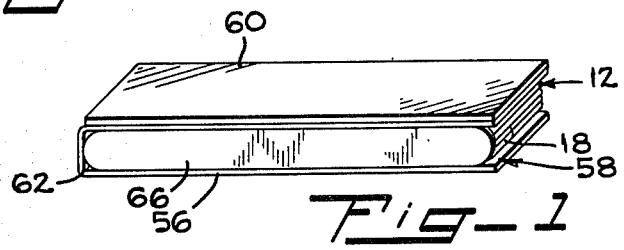
Fig-1
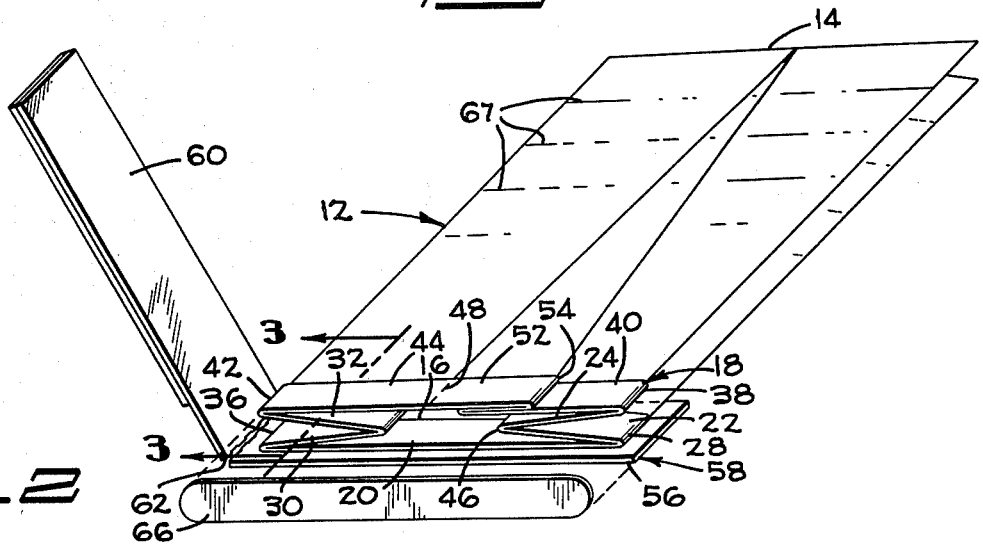
Fig-2
Fig-6
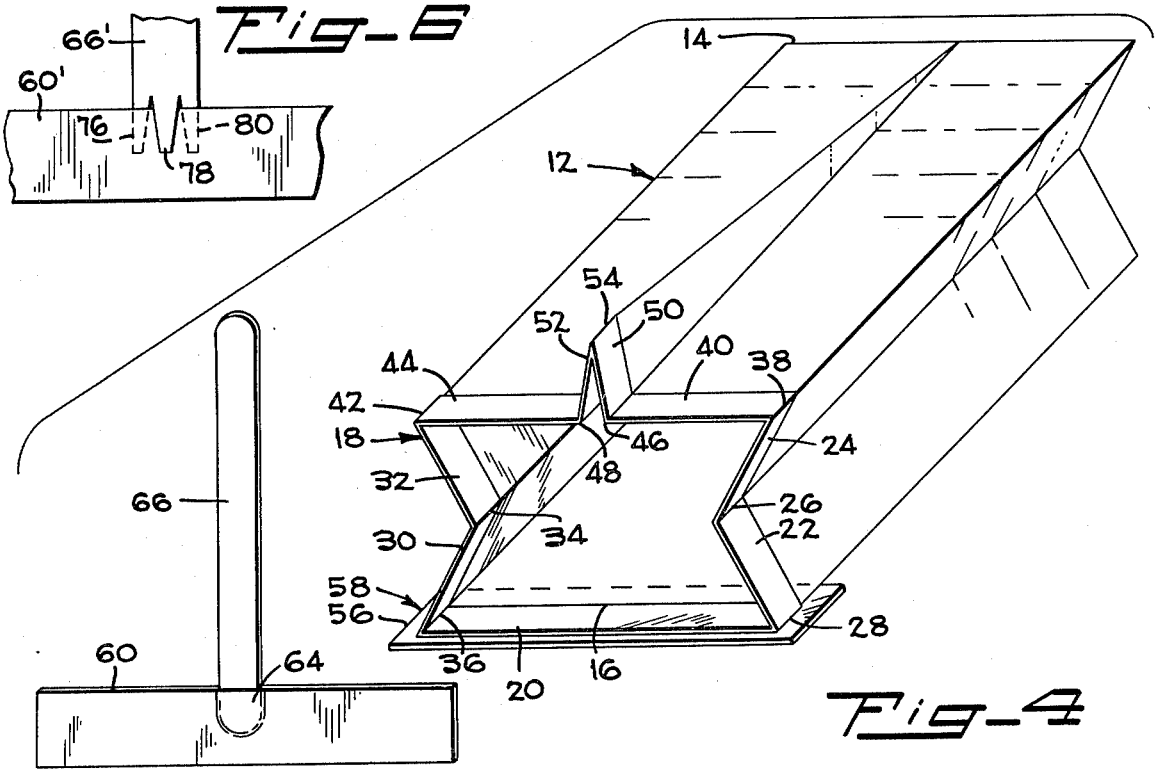
Fig-4

PICK UP AND DISPOSAL KIT FOR PET ORDURE

BACKGROUND OF THE INVENTION

1. Field of the Invention

This invention relates to a pick up and disposal kit for pet ordure and more particularly to such kit that can be constructed very economically and that can be carried in a pocket or purse prior to use.

2. Description of the Prior Art

U.S. Pat. No. 3,639,937 discloses a disposable self-packaging dustpan kit that includes a rigid carton which when open functions as a dustpan. The carton contains granular absorbent material and a separate hand paddle.

U.S. Pat. No. 3,767,247 discloses a bag to which is attached by a perforated line a pusher element. The bag is encased by a semi-rigid cardboard sleeve which is slidable therealong and which can be squeezed so as to effect opening of the bag to move pet droppings therein. The sleeve is not attached to the bag.

U.S. Pat. No. 3,854,578 discloses a dog dropping disposal kit which employs a bucket adapted to be lined by a disposable liner and includes a plurality of disposable shovel heads for picking up the droppings and placing them in the bucket liner.

U.S. Pat. No. 3,917,333 discloses a sanitary scoop in the form of a cardboard envelope that can be opened so that opposing edges thereof can be employed to grasp waste and move it into the center of the envelope where it can be compressed and discarded.

U.S. Pat. No. 3,971,503 discloses a cardboard container having an integral scoop.

U.S. Pat. No. 3,977,715 discloses a pick up device for animal droppings composed of a pair of tongs, one tong acting as a scoop and the other tong serving to support a disposable bag.

U.S. Pat. No. 4,017,015 discloses a carton formed of two telescoping parts which can be used to scoop up waste after which the two carton parts are telescoped together for subsequent disposal.

SUMMARY OF THE INVENTION

A pick up and disposal kit according to the present invention is foldable into a very compact self-contained unit which can be carried in pocket and purse, can be manufactured very inexpensively and can be dispensed from coin-operated machines and the like. The invention includes an impervious bag which prior to use is folded very compactly. Circumscribing the mouth of the bag is a relatively rigid foldable band which can likewise be folded into a compact, substantially flat condition. Forming an enclosure for the unit is a cardboard ply having a first segment joined to a part of the band to make the same more rigid and a second segment attached to the first segment along a perforated line. In order to ready the kit for use the second segment is detached from the first segment and employed as a pusher for transporting pet ordure into the bag. The band circumscribing the bag mouth is configured to define a gripping tab exterior of the bag and remote from the lower part thereof so that the kit can be used without soiling the hands of the user.

An object of the invention is to provide a pick up and disposal kit which can be inexpensively manufactured to permit disposal after one use. This object is achieved according to the present invention because the impervious bag is formed of a very inexpensive thermoplastic material and the band circumscribing the bag mouth is formed of heavy paper or cardboard.

Another object of the invention is to provide a pick up and disposal kit which can be folded into a sufficiently compact form that prior to use it can be carried in pocket or purse and can be sold through coin-operated dispensing machines. This object is achieved because the materials employed in constructing the device are foldable and are assembled so that the parts of the kit that form the enclosure can be used in picking up pet ordure.

The foregoing together with other objects, features and advantages will be more apparent after referring to the following specification and the accompanying drawings.

BRIEF DESCRIPTION OF THE DRAWINGS

FIG. 1 is a perspective view of a pick up and disposal kit of the invention in a folded condition.

FIG. 2 is a perspective view of the pick up and disposal kit in a partially unfolded condition.

FIG. 3 is a fragmentary view at enlarged scale taken along line 3—3 of FIG. 2.

FIG. 4 is a perspective view of a kit according to the invention in the unfolded, operative condition.

FIG. 5 is a fragmentary view at enlarged scale similar to FIG. 3 but showing a modification of the invention.

FIG. 6 is a fragmentary view showing another modification of the invention.

DESCRIPTION OF THE PREFERRED EMBODIMENT

Referring more particularly to the drawings, reference numeral 12 indicates an impervious bag formed of 1 mil polyethylene, water-proofed paper, or like inexpensive, flexible, impervious material. Bag 12 has a sealed or closed bottom 14 and a mouth 16 opposite the bottom through which access to the interior of the bag can be had. Circumscribing mouth 16 and secured to the bag by adhesive or the like is a continuous band 18 which is formed of cardboard or like semi-rigid material that is adapted to be foldable into a substantially flat condition. Band 18 includes a linear portion 20 which has a length sufficient to afford transport thereover of pet ordure. Extending upward from one longitudinal extremity of linear portion 20 is a lateral portion formed by two legs 22 and 24 which are relatively foldable by virtue of a score line 26 at their junction. Leg 22 is joined to linear portion 20 by means of a score line 28. At the opposite longitudinal extremity of linear portion 20 is a similar lateral portion formed by legs 30 and 32 which have a junction at a fold line 34 therebetween. The lower end of leg 30 is foldably joined to linear portion 20 at a score line 36.

The upper extremity of leg 24 is defined by a score line 38 from which extends a top leg 40 which, as can be seen in FIG. 4, is approximately parallel to linear portion 20 when the device is in the open or expanded condition. The upper extremity of leg 32 is defined by a score line 42 from which extends a top leg 44 which is substantially identical to top leg 40. The inner extremities of top legs 40 and 44 are defined by respective score lines 46 and 48; gripping portions 50 and 52 extend upward from the respective score lines, the gripping portions being joined to one another at a score line 54 and forming a gripping tab remote from linear portion 20.

Secured to linear portion 20 on the exterior surface thereof is a segment 56 of semi-rigid ply 58 which is formed of material similar to that which forms band 18. As can be seen in FIGS. 2 and 4, segment 56 is larger in both length and width than linear portion 20. Ply 58 also includes a segment 60 which is foldably secured to segment 56 by a perforated line 62. Perforated line 62 permits segment 60 to be detached from segment 56.

At least segment 60 of ply 58 is of laminated construction, there being at least two laminae which define therebetween a pocket 64. Pocket 64 is adapted to receive one end of a handle 66. Handle 66 can be formed of thin wood, plastic, or any other material having sufficient rigidity to serve as a handle while using segment 60 to scoop ordure pieces over linear portion 20 to the interior of bag 12.

The operation of the present invention will be described by first explaining how the device is formed into the folded condition of FIG. 1. Bag 12 is flattened along the crease lines on the side thereof, and band 18 is flattened by moving the inner surfaces of legs 40 and 44 toward the inner surface of linear portion 20. The lateral portions of the band fold along score lines 26 and 34 to permit such folded position. Moreover, the tab formed by gripping portions 50 and 52 is folded over at score line 46 as seen in FIG. 2. Finally bag 12 is folded or rolled at lines 67 so that the folded bag lies within the perimeter of segment 56. Segment 60 is folded down at perforated line 62 and releasably secured by adhesive or the like in the position shown in FIG. 1. Handle 66 can be mounted between segments 58 and 60 as seen in FIG. 1 or can be rolled up with bag 12. It will be appreciated that the device, in the folded position of FIG. 1, is extremely compact and lightweight. The device can be carried in pocket or purse and is of suitable shape for placement in coin-operated dispensing machines, which machines can be located near parks or like areas where persons are likely to exercise their pets.

When it is desired to utilize the kit, segment 60 is folded out along perforated line 62, bag 12 is unrolled to the position shown in FIG. 2 and handle 66 is removed. Segment 60 is torn off and one end of handle 66 is inserted into pocket 64 so as to form an ordure pusher as shown in FIG. 4. Next, band 18 is expanded by applying outward force to score lines 26 and 34 to erect the lateral portions of the band. Finally the tab formed by gripping portions 50 and 52 is erected to the position shown in FIG. 4 to provide a gripping tab that can be grasped between the thumb and forefinger of the user's hand. In such position the user's hand will be exterior of the bag and will be remote from linear portion 20.

With the device erected as described in the preceding paragraph, linear portion 20 can be manipulated into substantially coplanar relationship to a grassy surface or other ordure supporting surface. The linear portion can be maintained in such position because there is sufficient rigidity in the side legs to enable a person grasping gripping portions 50 and 52 to there hold the linear portion. Next the ordure is transported over linear portion 20 by means of the pusher formed by segment 60 and handle 66. When the ordure has been loaded into bag 12, the pusher can be placed in the bag and the neck of the bag can be closed without in any way soiling the user's hand. Thereafter the bag and its contents can be discarded in a suitable receptacle.

In the modification shown in FIG. 5 the band that circumscribes mouth 16 of bag 12, rather than being formed of a single layer of cardboard or like material is embodied by a band 68 which functions similarly to band 18. Band 68 includes an upper layer of paper 70, a lower layer of paper 72 and thin steel wire 74 sandwiched therebetween. Layers 70 and 72 are adhesively joined to one another and to the mouth of bag 14 so as to retain wire 74 in circumscribing relation to the mouth of the bag. The operation of the modification of FIG. 5 is identical in all respects to that described above. Wire 74 affords sufficient rigidity for maintaining the device in the position shown in FIG. 4 to permit convenient loading of ordure to the bag interior.

FIG. 6 shows a modification in the means for fastening the rigid handle to the ordure pusher. In FIG. 6 is shown a fragment of a handle 66', which is similar to handle 66 described above, and a pusher segment 60' which is similar to segment 60 described above. Segment 60' need not define a pocket therein because the lower end of handle 66' has a fork-like configuration including tines 76,78 and 80. The material of which handle 66' and the tines are constructed has a degree of elasticity so that when segment 60' is fitted between the tines, with tines 76 and 80 on one side of the segment and tine 78 on the other side of the segment, the pusher segment is joined to handle 66'.

In the preceding description, segment 60 is described as being joined to segment 56 along a perforated line 62. Such perforated attachment is convenient in that segment 60 can form a part of the outer package for the kit. A satisfactory alternate form, however, is to provide segment 60 as a separate piece which is retained with the kit, before use, by a suitable wrapper or the like.

Thus it will be seen that the present invention provides an ordure pick up and disposal kit which can be packaged in an extremely compact package of inexpensive materials. Moreover, the bag can be quickly and conveniently unfolded into the operative condition and can be loaded with ordure without in any way soiling the user's hands. Finally because the parts of which the kit is constructed are so inexpensive, it is entirely feasible that the entire kit be discarded after one use.

Although several embodiments of the invention have been shown and described it will be obvious that other adaptations and modifications can be made without departing from the true spirit and scope of the invention.

What is claimed is:

1. An ordure pick up and disposal kit comprising an impervious flexible bag defining a mouth at one end thereof, a semi-rigid substantially continuous band secured to said bag in circumscribing relation to said mouth, said band having a uniform width throughout its length and having a straight edge so that said mouth resides in a single plane, said band including a substantially undeformed linear portion having first and second ends and being conformable to a generally planar ordure supporting surface, said band having means forming a foldable gripping tab opposite said linear portion and extending exteriorly of said bag, said band having first and second side portions extending from said gripping tab forming means to the respective ends of said linear portion for spacing said linear portion from said gripping tab, and means for transporting ordure over said linear portion into the interior of said bag, said transporting means including a substantially rigid ply substantially coextensive in length and width with said undeformed linear portion so as to afford compact storage of the kit, said ply being separable from said undeformed linear portion for effecting ordure transport over said linear portion into the interior of said bag.

2. A pick up and disposal kit according to claim 1 wherein said ply has a first segment joined to said linear portion and a second segment removably joined to said first segment along a perforated line, said transporting means including said second segment.

3. A pick up and disposal kit according to claim 2 wherein said transporting means includes a substantially rigid handle and means for attaching said handle to said second segment.

4. A pick up and disposal kit according to claim 3 wherein said handle attaching means includes means in said second segment for defining a pocket, said handle being insertable in said pocket.

* * * * *